US011054135B2

(12) United States Patent
Cioncolini et al.

(10) Patent No.: US 11,054,135 B2
(45) Date of Patent: Jul. 6, 2021

(54) GAS TURBINE FUEL NOZZLE WITH INTEGRATED FLAME IONIZATION SENSOR AND GAS TURBINE ENGINE

(71) Applicant: Nuovo Pignone Tecnologie SRL, Florence (IT)

(72) Inventors: Stefano Cioncolini, Florence (IT); Michele D'Ercole, Letany (CZ); Antonio Asti, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 86 days.

(21) Appl. No.: 15/576,036

(22) PCT Filed: May 23, 2016

(86) PCT No.: PCT/EP2016/061576
§ 371 (c)(1),
(2) Date: Nov. 21, 2017

(87) PCT Pub. No.: WO2016/188954
PCT Pub. Date: Dec. 1, 2016

(65) Prior Publication Data

US 2018/0156457 A1 Jun. 7, 2018

(30) Foreign Application Priority Data

May 25, 2015 (IT) ..... 102015000017588

(51) Int. Cl.
*F23R 3/28* (2006.01)
*F23N 5/12* (2006.01)
*F23N 5/24* (2006.01)

(52) U.S. Cl.
CPC ..... *F23N 5/123* (2013.01); *F23N 5/242* (2013.01); *F23R 3/286* (2013.01);
(Continued)

(58) Field of Classification Search
CPC ..... F23N 5/123; F23N 5/126; F23N 5/245; F23N 2029/00; F23N 2029/16;
(Continued)

(56) References Cited

U.S. PATENT DOCUMENTS 3,836,857 A 9/1974 Ikegami et al.
5,073,104 A 12/1991 Kemlo
(Continued)

FOREIGN PATENT DOCUMENTS

CN 1847835 A 10/2006
CN 101793409 B 3/2014
(Continued)

OTHER PUBLICATIONS

Thermo-Electric Instrumentation "Gas Turbine Temperature Sensors", accessed online at https://www.thermo-electric.nl/gas-turbine-temperature-sensors on Sep. 25, 2019 with an earliest publication date of Dec. 16, 2014 accessible via the Wayback Machine (Year: 2014).*

(Continued)

*Primary Examiner* — Scott J Walthour
(74) *Attorney, Agent, or Firm* — Baker Hughes Patent Org.

(57) ABSTRACT

A gas turbine fuel nozzle for a combustor of a gas turbine engine comprises a sleeve with an internal duct for premixed fuel gas flow; it further comprises a flame ionization sensor located on the sleeve externally to the duct; typically, the combustor has a single annular-shaped chamber.

10 Claims, 8 Drawing Sheets

(52) U.S. Cl.
CPC ..... *F23N 2241/20* (2020.01); *F23N 2900/00* (2013.01); *F23N 2900/05005* (2013.01)

(58) Field of Classification Search
CPC ..... F23N 2041/20; F23N 2900/00; F23N 2900/05005; F23R 3/286
See application file for complete search history.

(56) References Cited

U.S. PATENT DOCUMENTS

| | | | | |
|---|---|---|---|---|
| 5,472,337 | A | 12/1995 | Guerra | |
| 5,969,617 | A | 10/1999 | Garthe | |
| 6,363,725 | B1 | 4/2002 | Mei | |
| 6,429,020 | B1 | 8/2002 | Thornton et al. | |
| 6,887,069 | B1 | 5/2005 | Thornton et al. | |
| 6,993,960 | B2 | 2/2006 | Benson | |
| 2004/0123652 | A1 | 7/2004 | Benson | |
| 2004/0123653 | A1 | 7/2004 | Benson | |
| 2006/0163065 | A1 | 7/2006 | Benson et al. | |
| 2007/0059655 | A1* | 3/2007 | Brunner | F23N 5/022 431/9 |
| 2007/0119147 | A1* | 5/2007 | Cornwell | F01D 17/02 60/39.281 |
| 2009/0013693 | A1 | 1/2009 | Ols | |

FOREIGN PATENT DOCUMENTS

| | | | |
|---|---|---|---|
| EP | 1389713 | A1 | 2/2004 |
| EP | 1686373 | A1 | 8/2006 |
| JP | 2001116257 | A | 4/2001 |
| JP | 2006227001 | A | 8/2006 |
| JP | 2007056868 | A | 3/2007 |
| JP | 2009216098 | A | 9/2009 |

OTHER PUBLICATIONS

Italian Search Report issued in connection with corresponding Italian application No. 102015000017588 dated Jan. 20, 2016.
International Search Report and Written Opinion issued in connection with corresponding PCT application No. PCT/EP2016/061576 dated Aug. 5, 2016.

* cited by examiner

GAS TURBINE FUEL NOZZLE WITH INTEGRATED FLAME IONIZATION SENSOR AND GAS TURBINE ENGINE

TECHNICAL FIELD

Embodiments of the subject matter disclosed herein correspond to gas turbine fuel nozzles with integrated flame ionization sensor and gas turbine engines.

BACKGROUND ART

It is known that the generation and the movement of ions in a flame are very useful parameters for monitoring the flame and the combustion and the use of sensors therefor.

In principle, a single flame ionization sensor may replace a whole set of sensors dedicated to a corresponding set of flame and/or combustion indicators.

Anyway, incorporating a flame ionization sensor in a combustor of a gas turbine engine is not trivial at all; in fact, in such applications, any component facing the combustion chamber is critical from the shape point of view due to the gasses flows and risks of being damaged by the hostile environment (high temperature, high pressure, aggressive gasses, etc.) present in the combustion chamber. Another requirement for such sensor is its placing so that it can be replaced easily.

Furthermore, in the field of "Oil & Gas", a very high reliability is required to the machines in general and consequently to their components, including sensors.

Therefore, in the field of "Oil & Gas", flame ionization sensors are quite seldom used in gas turbine engines.

SUMMARY

It is to be noted that in a gas turbine engine having a combustor with a single annular-shaped chamber and a plurality of fuel nozzles one or few (for example two or three or four or more) flame ionization sensors may be sufficient for serving the whole turbine diagnosis and control; anyway, such sensors have never been used for such applications.

Therefore, there is a general need for a gas turbine fuel nozzle with integrated flame ionization sensor and a corresponding gas turbine engine. This need is particularly felt in gas turbine engines comprising a combustor with a single annular-shaped chamber.

First embodiments of the subject matter disclosed herein relate to a gas turbine fuel nozzle.

According to such nozzle, there is a sleeve with an internal duct for premixed fuel gas flow; it further comprises a flame ionization sensor located on said sleeve externally to the duct.

Second embodiments of the subject matter disclosed herein relate to a gas turbine engine.

According to such gas turbine engine, there is a combustor with a single annular-shaped chamber; it further comprises a plurality of fuel nozzles with one or more integrated flame ionization sensors.

BRIEF DESCRIPTION OF DRAWINGS

The accompanying drawings, which are incorporated herein and constitute an integral part of the present specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
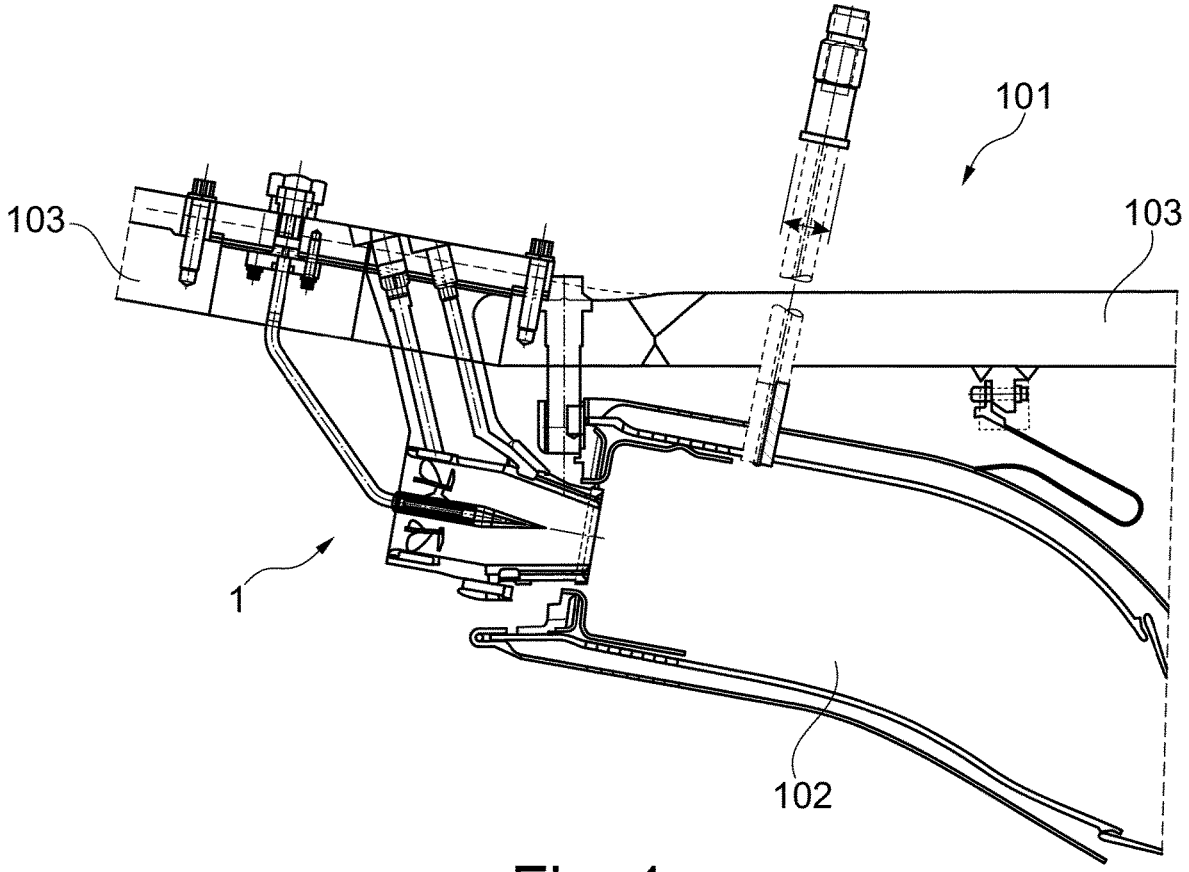
FIG. 1 shows a partial cross-section view of an embodiment of a combustor of a gas turbine engine.

FIG. 1 shows a partial cross-section view of an embodiment of a combustor 101 of a gas turbine engine 100; a single annular-shaped chamber 102 is located inside a case 103.

Figure 3:
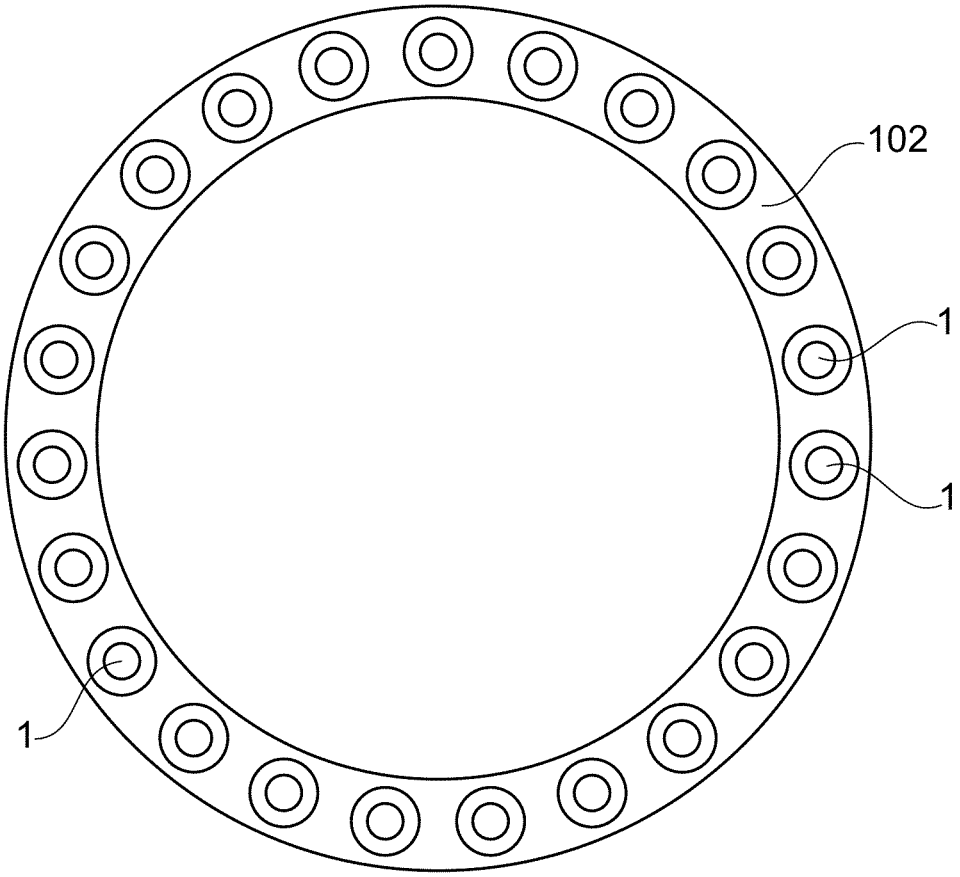
FIG. 3 shows a schematic front view of an embodiment of a combustor of a gas turbine engine.

FIG. 3 shows a schematic front view of the combustion chamber 102 of FIG. 1.

The combustor 101 comprises a plurality of fuel nozzles 1 (shown both in FIG. 1 and in FIG. 3).

Figure 2:
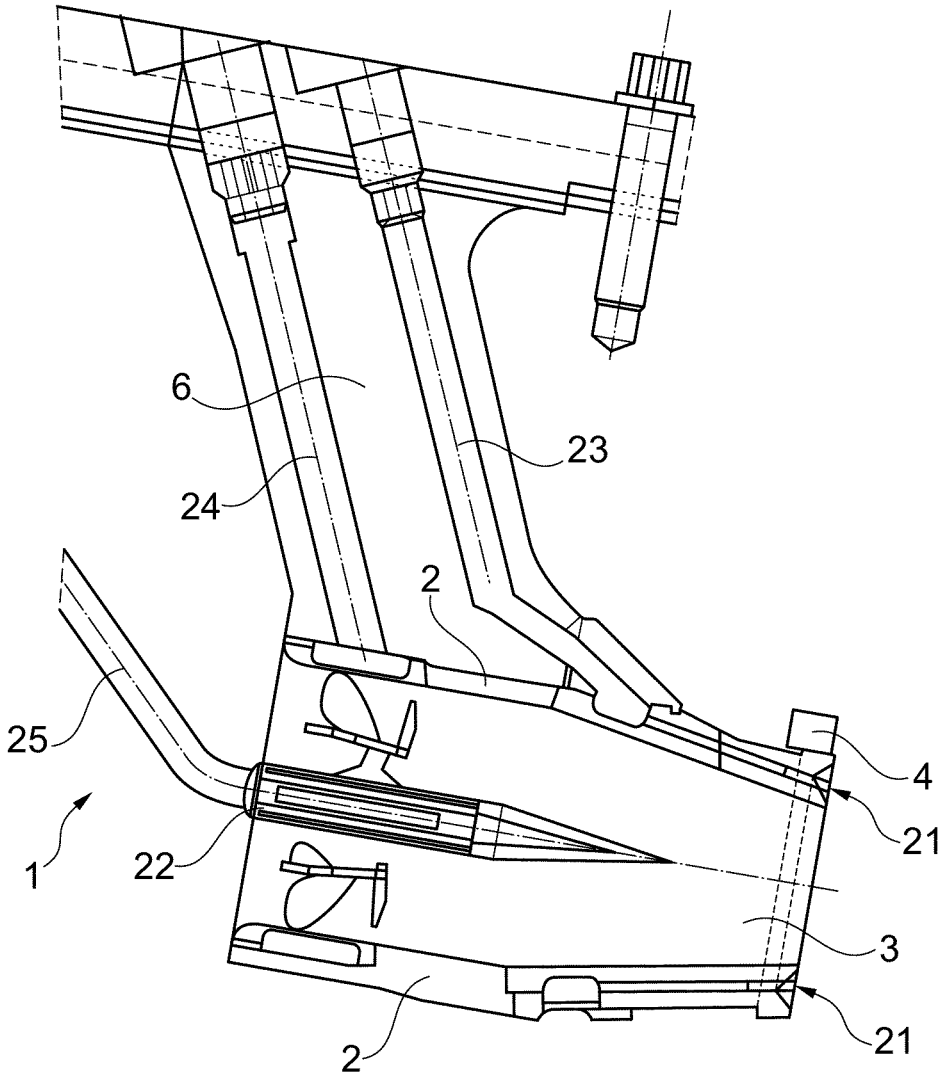
FIG. 2 shows a cross-section view of an embodiment of a fuel nozzle.

The fuel nozzles 1 have one or more integrated flame ionization sensors; this is schematically shown in FIG. 2 where the sensor is associated to reference 4.

Figure 4:
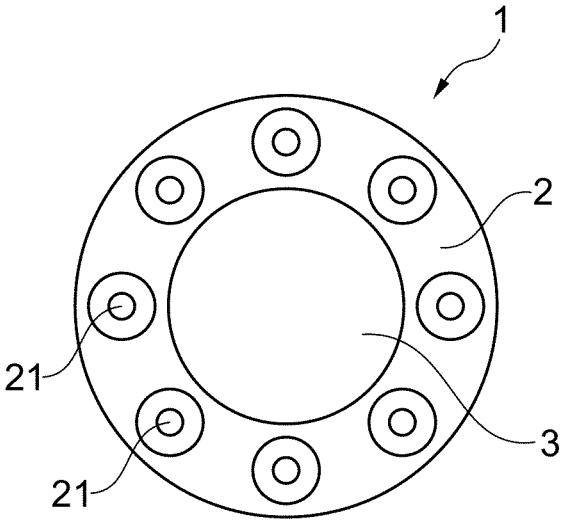
FIG. 4 shows a schematic front view of an embodiment of a fuel nozzle.

An embodiment of a fuel nozzle 1 is shown both in FIG. 2 (cross-section view) and in FIG. 4 (schematic front view).

The gas turbine fuel nozzle 1 comprises a cylindrical metallic sleeve 2 with an internal circular (cross-section) duct 3 for premixed fuel gas flow. A plurality of ducts 21 for fuel gas flow are arranged as a crown inside the peripheral wall of sleeve 2 and end on a front side of sleeve 2. Inside duct 3, coaxially to sleeve 2, there is a body 22. Ducts 21 are in fluid communication with a conduit 23 for air gas flow. A conduit 24 ends at a back side of sleeve 2 so to feed premixed fuel gas flow. A conduit 25 feeds an air gas flow to body 22 so to eject air inside duct 3 close to the end of sleeve 2. There is a support arm 6 integrated with sleeve 2; support arm 6 houses conduit 23 and conduit 24; in general, nozzle support may partially or completely house at least one gas flow conduit for the nozzle.

A nozzle like the one shown in the figures, in particular FIG. 2, is described and shown in detail in U.S. Pat. No. 6,363,725, assigned to the present Applicant, that is incorporated herewith by reference.

As schematically shown for example in FIG. 2, nozzle 1 further comprises a flame ionization sensor 4 located on sleeve 2 externally to duct 3.

The flame ionization sensor is located at an end zone of the sleeve where premixed fuel gas flow is ejected—see e.g. FIG. 2.

In particular, flame ionization sensor may be located on a external lateral side or on a front side of the sleeve. In the embodiment of FIG. 2, the sensor 4 is located on a external lateral side. In the embodiments of FIGS. 5-9, the sensor 4 is located on a front side of the sleeve; in particular, sensor 4 is located on a front side of sleeve 2 at an outer portion of said sleeve 2.

The flame ionization sensor 4 of the embodiments of FIGS. 5-9 comprises a metallic (full or partial) annulus 41 being an electrode of the sensor. Annulus 41 may be electrical isolated from sleeve 2 e.g. by an underlying isolating (full or partial) annulus 42; the material of annulus 42 may be for example ceramic or ceramic oxide. Such design of sensor 4 may be used also for sensor 5 in FIG. 9.

The flame ionization sensor is to be electrically connected to an electric cable for feeding the generated signal to a monitoring and/or controlling electronic unit.

Figure 5:
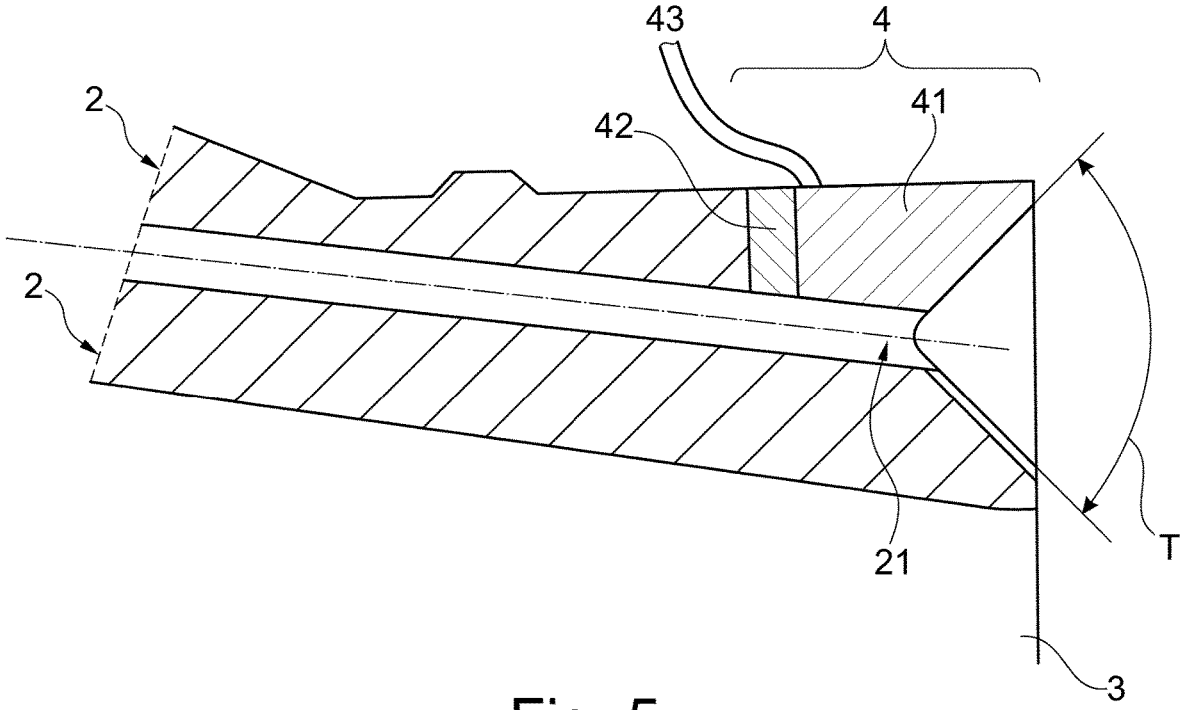
FIG. 5 shows a partial cross-section view of a first embodiment of a fuel nozzle with one integrated flame ionization sensor.
Figure 6:
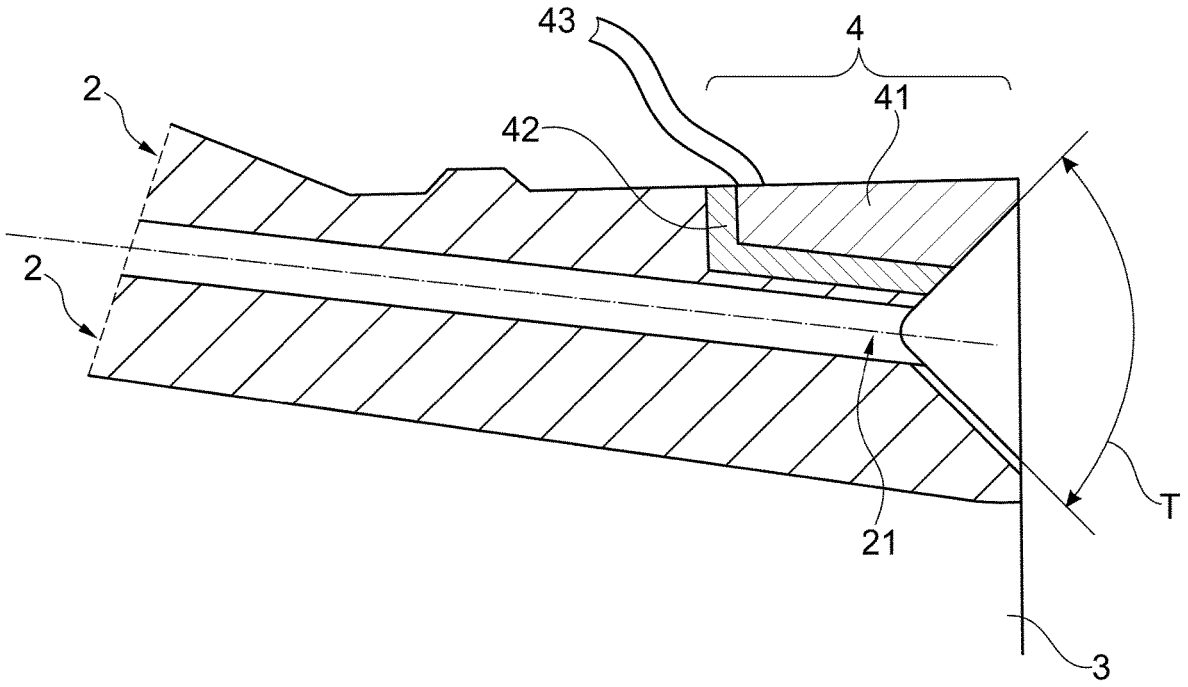
FIG. 6 shows a partial cross-section view of a second embodiment of a fuel nozzle with one integrated flame ionization sensor.
Figure 7:
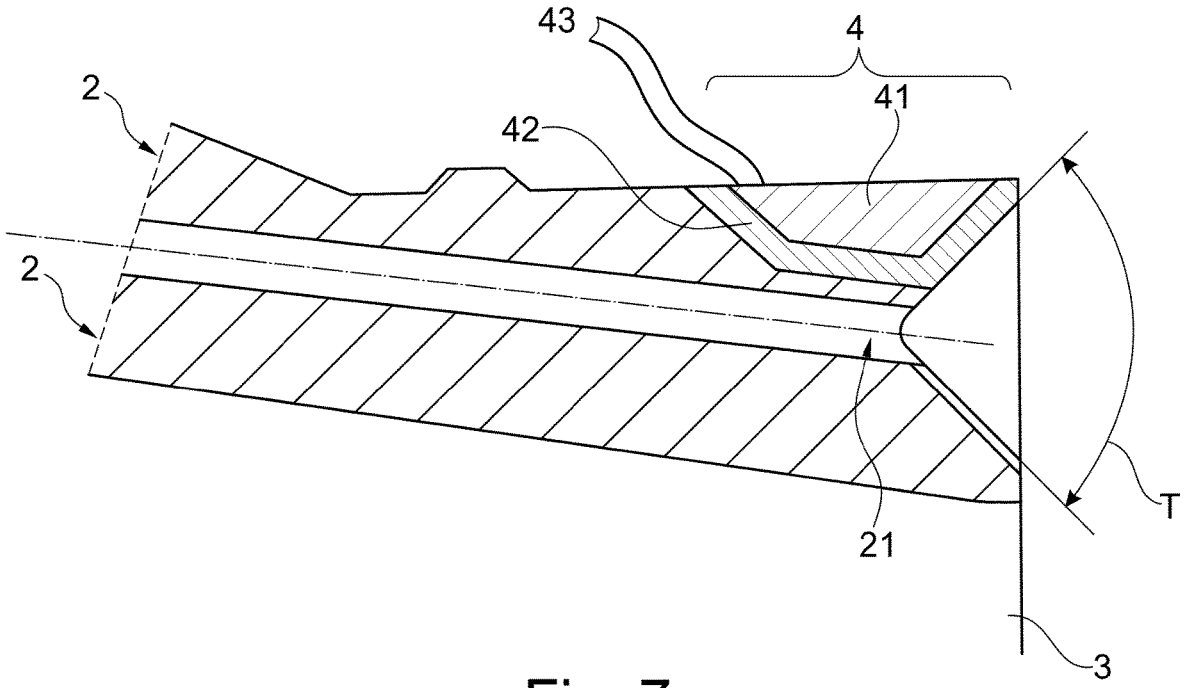
FIG. 7 shows a partial cross-section view of a third embodiment of a fuel nozzle with one integrated flame ionization sensor.

In an embodiment, the electric cable is a rigid shielded mineral-insulated cable (schematically shown in FIGS. 5-7 as element 43). Shielding the cable may be advantageous due to the "noisy" environment of a gas turbine engine; shielding may be done through a metal cladding, for example made of AISI 316 or INCONEL 600.

The electric cable may be fixed to support arm 6. In general, nozzle support may partially or completely house at least one (shielded) electric cable for a sensor.

Figure 9:
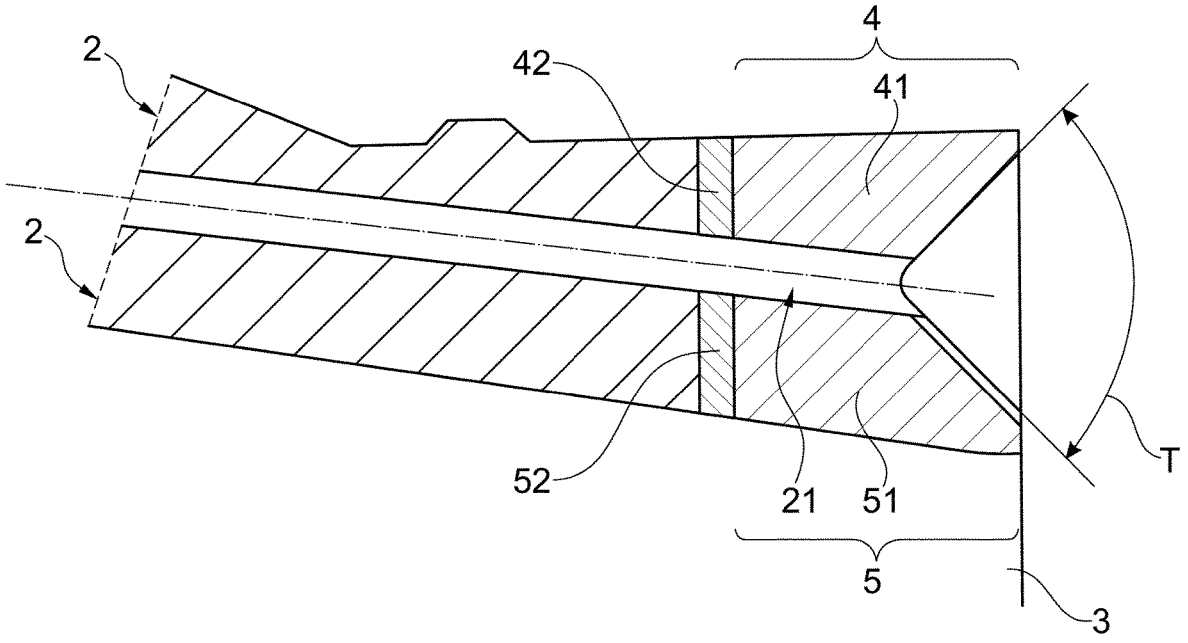
FIG. 9 shows a partial cross-section view of a fifth embodiment of a fuel nozzle with two integrated flame ionization sensors.

In the embodiment of FIG. 9, there is another flame ionization sensor 5 located on a front side of sleeve 2 and externally to duct 3, at an inner portion sleeve 2.

The sensor 5 of the embodiment of FIG. 9 comprises a metallic (full or partial) annulus 51 being an electrode of the sensor. Annulus 51 may be electrical isolated from sleeve 2 e.g. by an underlying isolating (full or partial) annulus 52; the material of annulus 52 may be for example ceramic or ceramic oxide.

In the embodiment of FIG. 9, sensor 4 is used as a primary flame ionization sensor and sensor 5 is used as flashback flame ionization sensor.

In FIGS. 5-9, an end portion of a duct 21 inside sleeve 2 (surrounding duct 3) is shown that ends with a conical outlet ("T" degrees wide) for a pilot flame.

In the embodiment of FIG. 5, a metallic component 41 of the flame ionization sensor 4 forms part of the external lateral side of sleeve 2, part of the front side of sleeve 2 (i.e. part of the conical outlet), and part of the surface of duct 21.

In the embodiment of FIG. 6, a metallic component 41 of the flame ionization sensor 4 forms part of the external lateral side of sleeve 2, part of the front side of sleeve 2 (i.e. part of the conical outlet), and is spaced from the surface of duct 21 through e.g. isolating component 42.

In the embodiment of FIG. 7, a metallic component 41 of the flame ionization sensor 4 forms part of the external lateral side of sleeve 2, and is spaced from the front side of sleeve 2 (i.e. part of the conical outlet) through e.g. only isolating component 42, and from the surface of duct 21 through e.g. isolating component 42.

Figure 8:
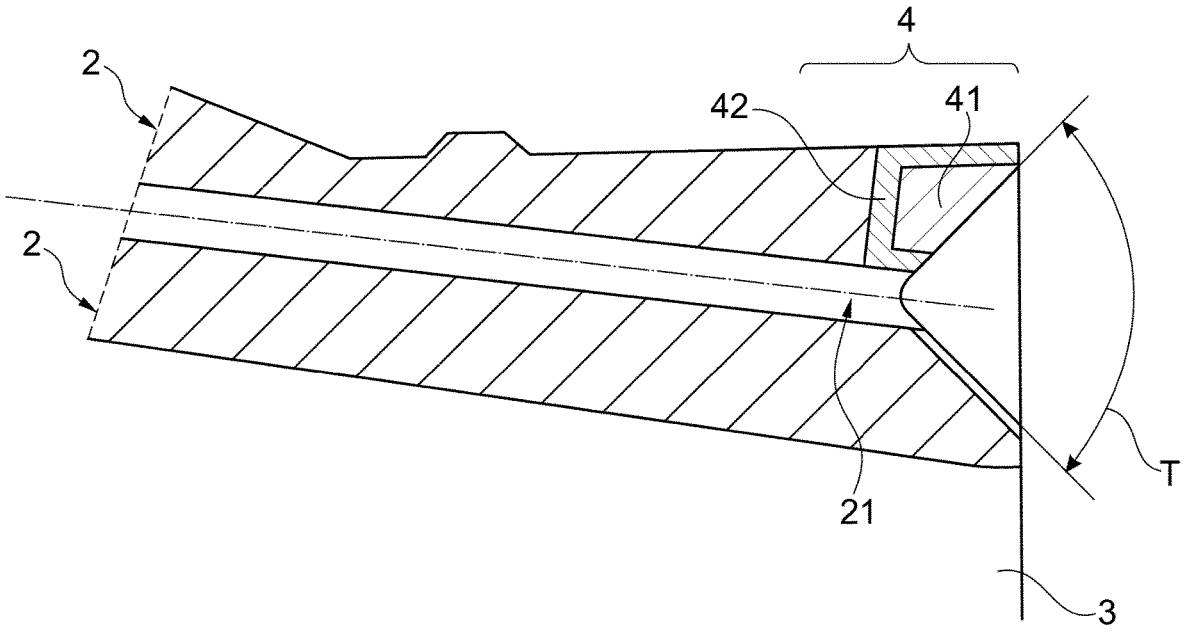
FIG. 8 shows a partial cross-section view of a fourth embodiment of a fuel nozzle with one integrated flame ionization sensor.

In the embodiment of FIG. 8, a metallic component 41 of the flame ionization sensor 4 forms only part of the front side of sleeve 2 (i.e. part of the conical outlet) and is surrounded by isolating component 42.

In the embodiment of FIG. 9, a metallic component 41 of a first flame ionization sensor 4 forms part of the external lateral side of sleeve 2, part of the front side of sleeve 2 (i.e. part of the conical outlet), and part of the surface of duct 21; and a metallic component 51 of a second flame ionization sensor 5 forms part of the internal lateral side of sleeve 2, part of the front side of sleeve 2 (i.e. part of the conical outlet), and part of the surface of duct 21.

Embodiments of the gas turbine fuel nozzle disclosed herein may be used for monitoring combustion in a gas turbine engine, in particular flashback combustion.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A gas turbine fuel nozzle, the gas turbine fuel nozzle comprising:

a sleeve having a peripheral wall surrounding and defining an internal duct to enable premixed fuel gas flow, the internal duct defining a central axis and the peripheral wall being cylindrical and further defining a reduced diameter portion having a reduced diameter relative to a diameter of an adjacent portion of the peripheral wall, the peripheral wall having at least one fuel duct formed between a radially inner surface of the peripheral wall and a radially outer surface of the peripheral wall, the peripheral wall defining an end face and an outlet of the at least one fuel duct is defined by the peripheral wall in the end face; and a flame ionization sensor located radially outward from the internal duct in the reduced diameter portion of the peripheral wall of the sleeve, the flame ionization sensor comprising a first annulus, which is an electrode, and an isolating annulus that electrically isolates the first annulus from the peripheral wall of the sleeve, wherein the outlet of the at least one fuel duct is a conical outlet defining a conical internal surface and the electrode defines a portion of the conical internal surface.

2. The gas turbine fuel nozzle of claim 1, wherein said flame ionization sensor is located at an end of the sleeve where premixed fuel gas flow is ejected by the gas turbine fuel nozzle from the internal duct.

3. The gas turbine fuel nozzle of claim 1, wherein said flame ionization sensor is electrically connected to a shielded mineral-insulated cable.

4. The gas turbine fuel nozzle of claim 1, wherein said at least one fuel gas duct comprises a plurality of fuel gas ducts surrounding the internal duct.

5. The gas turbine fuel nozzle of claim 1, wherein the flame ionization sensor is a first flame ionization sensor, the gas turbine fuel nozzle further comprising a second flame ionization sensor located in the reduced diameter portion of the peripheral wall and radially outward from the internal duct.

6. The gas turbine fuel nozzle of claim 1, further comprising a support fixed to or integrated with said sleeve, wherein said support houses at least one electric cable for the flame ionization sensor.

7. A gas turbine engine comprising at least one gas turbine fuel nozzle according to claim 1.

8. The gas turbine fuel nozzle of claim 1, wherein the radially outer surface forms an exterior surface of the gas turbine fuel nozzle.

9. The gas turbine fuel nozzle of claim 1, wherein the sleeve defines an internal volume along an entirety of the length of the sleeve, the internal duct is formed within said internal volume, and the flame ionization sensor is located radially outward from said internal volume and defines a portion of the radially outer surface of the peripheral wall.

10. The gas turbine fuel nozzle of claim 5, wherein the second flame ionization sensor comprises a second annulus, which is an electrode of the second flame ionization sensor, and a second isolating annulus that electrically isolates the second annulus from the sleeve.

* * * * *